US009063509B2

(12) United States Patent
Liu et al.

(10) Patent No.: US 9,063,509 B2
(45) Date of Patent: Jun. 23, 2015

(54) COATING APPARATUSES AND METHODS

(71) Applicant: Xerox Corporation, Norwalk, CT (US)

(72) Inventors: Yu Liu, Mississauga (CA); Yu Qi, Oakville (CA); Vladislav Skorokhod, Vaughan (CA); Johann Junginger, Toronto (CA); Sarah Vella, Milton (CA); Nan-Xing Hu, Oakville (CA)

(73) Assignee: Xerox Corporation, Norwalk, CT (US)

( * ) Notice: Subject to any disclaimer, the term of this patent is extended or adjusted under 35 U.S.C. 154(b) by 55 days.

(21) Appl. No.: 13/939,557

(22) Filed: Jul. 11, 2013

(65) Prior Publication Data

US 2015/0016834 A1 Jan. 15, 2015

(51) Int. Cl.
*G03G 21/00* (2006.01)

(52) U.S. Cl.
CPC ..... *G03G 21/0023* (2013.01); *G03G 21/0094* (2013.01)

(58) Field of Classification Search
CPC ..... G03G 21/0011; G03G 21/0023; G03G 21/0094
USPC ..... 399/71, 346, 350
See application file for complete search history.

(56) References Cited

U.S. PATENT DOCUMENTS

| | | | | |
|---|---|---|---|---|
| 8,086,142 | B2 | 12/2011 | Gilmartin et al. | |
| 2002/0021922 | A1 * | 2/2002 | Katoh et al. | 399/346 |
| 2007/0027038 | A1 | 2/2007 | Kamimura et al. | |
| 2010/0077792 | A1 | 4/2010 | Gurin | |
| 2012/0207651 | A1 | 8/2012 | Micheli et al. | |

FOREIGN PATENT DOCUMENTS

JP 2011232572 A * 11/2011

* cited by examiner

*Primary Examiner* — David Gray
*Assistant Examiner* — Laura Roth
(74) *Attorney, Agent, or Firm* — Fay Sharpe LLP

(57) ABSTRACT

An imaging apparatus includes an imaging member having a surface, a delivery member that is spaced apart from the imaging member, and a power source for generating an electric field between the imaging member surface and the delivery member. A functional material is electrohydrodynamically transferred from the delivery member to the imaging member surface when the electric field is generated.

20 Claims, 4 Drawing Sheets

COATING APPARATUSES AND METHODS

BACKGROUND

The present disclosure relates to systems and methods for applying a coating layer of a liquid functional material on an imaging member surface.

Electrostatographic and xerographic reproductions may be initiated by depositing a uniform charge on an imaging member (i.e., photoreceptor), followed by exposing the imaging member to a light image of an original document. Exposing the charged imaging member to a light image causes discharge in areas corresponding to non-image areas of the original document while the charge is maintained on image areas, creating an electrostatic latent image of the original document on the imaging member. The latent image is subsequently developed into a visible image by depositing a charged developing material (i.e., toner) onto the photoconductive surface layer, such that the developing material is attracted to the charged image areas on the imaging member. Thereafter, the developing material is transferred from the imaging member to a copy sheet or some other image support substrate to which the image may be permanently affixed for producing a reproduction of the original document. In a final step in the process, the imaging member is cleaned to remove any residual developing material therefrom, in preparation for subsequent imaging cycles.

The described electrophotographic copying process is well known and is commonly used for light lens copying of an original document. Analogous processes also exist in other electrophotographic printing applications such as, for example, digital laser printing and reproduction where charge is deposited on a charge retentive surface in response to electronically generated or stored images.

To charge the surface of a photoreceptor (P/R), a contact type charging device has been used, such as disclosed in U.S. Pat. Nos. 4,387,980 and 7,580,655, which are incorporated herein by reference in their entireties. The contact type charging device, also termed "bias charge roll" (BCR), includes a conductive member which is supplied a voltage from a power source with a D.C. voltage superimposed with an A.C. voltage of no less than twice the level of the D.C. voltage. The charging device contacts the image bearing member (photoreceptor) surface, which is a member to be charged.

Electrophotographic photoreceptors can be provided in a number of forms. For example, the photoreceptors can be a homogeneous layer of a single material, such as vitreous selenium, or it can be a composite layer containing a photoconductive layer and another material. In addition, the photoreceptor can be layered. Multilayered photoreceptors or imaging members have at least two layers, and may include a substrate, a conductive layer, an optional undercoat layer (sometimes referred to as a "charge blocking layer" or "hole blocking layer"), an optional adhesive layer, a photogenerating layer (sometimes referred to as a "charge generation layer," "charge generating layer," or "charge generator layer"), a charge transport layer, and an optional overcoating layer in either a flexible belt form or a rigid drum configuration. In the multilayer configuration, the active layers of the photoreceptor are the charge generation layer (CGL) and the charge transport layer (CTL). Enhancement of charge transport across these layers provides better photoreceptor performance. Multilayered flexible photoreceptor members may include an anti-curl layer on the backside of the substrate, opposite to the side of the electrically active layers, to render the desired photoreceptor flatness.

In recent years, organic photoreceptors have been widely used for electrographic purposes. This is because organic photoreceptors are easy to prepare at low cost and have the advantages of mechanical flexibility, easy disposability and environmental sustainability. However, the microcorona generated during repetitive charging damages the organic photoconductor, resulting in a rapid wear of the imaging surface and shortening the life of the photoreceptor.

To further increase the service life of the photoreceptor, use of overcoat layers has also been implemented to protect photoreceptors and improve performance, such as wear resistance. However, these low wear overcoats are associated with poor image quality in a humid environment as the wear rates decrease to a certain level. In addition, high friction associated with low wear overcoats in the humidity environment also causes severe issues with BCR charging systems, such as motor failure due to high friction/torque and blade damage. As well, toner or additive particles remaining on the photoreceptor after transferring could not be effectively cleaned by the cleaning blade. As a result, use of a low wear overcoat with BCR charging systems is still a challenge, and there is a need to find ways to increase the life of the photoreceptor with excellent image quality and charging performance.

An applicator to apply functional material (such as paraffin oil) to the surface of the photoreceptor was disclosed in U.S. patent application Ser. Nos. 13/279,981 and 13/326,414, which are hereby incorporated in their entireties by reference herein. The applied thin layer of functional material addresses image deletion, alleviates chattering of the cleaning blade, and reduces toner/additive contamination on the BCR. However, as a roll-type design, it is difficult to control the contact force of the roller surface of the applicator against the surface of the photoreceptor or the BCR along the entire length during rotation, which affects the rate of diffusion of oil from the delivery roller and results in an uneven distribution of oil, particularly at the two ends of the photoreceptor or BCR surface. As a result, after long term prints, toner density across a page becomes uneven, thus the edges of the images sometimes become darker than the middle due to an excess amount of delivered oil. This can further cause the delivery roller to become contaminated with toner and additives over time due to inefficient cleaning of the surface of the photoreceptor (P/R) by the cleaning blade. Toner particles are eventually transferred to and contaminate the surface of the BCR.

In U.S. patent application Ser. No. 13/437,472, a blade applicator to apply an ultrathin layer of liquid phase functional materials on the surface of a P/R or a surface of a BCR is described. The blade applicator is in contact with the P/R surface or the BCR surface in a trailing configuration. However, the friction between the applicator and the surface of the P/R or the surface of the BCR can cause the contact edge on the blade to wear and cause non-uniform diffusion of the functional material on the surface of the P/R or the surface of the BCR. In addition, long term wear of the contact edge of the blade can result in contamination of toner or additives which can lever the blade edge away from surface of the P/R or the surface of the BCR, creating areas on the surface of the P/R or the surface of the BCR where no functional material is applied. This can cause damage of cleaning blade and image failure.

It would be desirable to develop contactless systems and methods for applying functional materials to an imaging member surface which permit accurate control of the amount of the functional material, without degrading image quality.

BRIEF DESCRIPTION

The present disclosure relates to systems and methods for coating imaging members with a functional material, such as a lubricant, without directly contacting the surface of the imaging members using another system component.

Disclosed in embodiments is a method for providing a liquid functional material to an imaging member surface. The method includes generating an electric field between the imaging member surface and a deliver member. The delivery member is spaced apart from the imaging member surface. The delivery member includes a reservoir containing the liquid functional material and a plurality of capillary openings. The functional material is electrohydrodynamically delivered to the imaging member surface when the electric field is generated.

The electric field may be in the range of from about 50 to about 500 kV/m.

The plurality of capillary openings may be located from about 0.1 mm to about 30 mm from the imaging member surface.

The functional material may be selected from alkanes, fluoroalkanes, alkyl silanes, fluoroalkyl silanes alkoxy-silanes, siloxanes, glycols or polyglycols, mineral oil, synthetic oil, natural oil, and mixtures thereof.

The functional material may be a paraffin oil.

The capillary openings may have an area in the range of from about 100 $\mu m^2$ to about 5 $mm^2$.

Disclosed in other embodiments is an image forming apparatus including an electrostatic imaging member having a charge-retentive surface to receive an electrostatic latent image thereon, a bias charging unit for applying an electrostatic charge on the charge-retentive surface to a predetermined electric potential; an exposing unit that exposes the charge-retentive surface to form an electrostatic latent image; a developing unit that develops the electrostatic latent image using a developer containing toner to form a toner image; a transferring unit that transfers the toner image to a recording medium; a cleaning unit that removes toner remaining on the surface of the image bearing member; and a delivery member for providing a liquid functional material to the charge-retentive surface. A voltage bias unit is used for adjusting an electric field between the delivery member and the charge-retentive surface to electrohydrodynamically jet the functional material from the delivery member to the charge-retentive surface.

The imaging member surface may be spaced apart from the delivery member at a distance from about 0.1 mm to about 30 mm.

The delivery member may include a reservoir.

The delivery member may include a plurality of capillary openings directed towards the imaging member surface.

The functional material may be selected from alkanes, fluoroalkanes, alkyl silanes, fluoroalkyl silanes alkoxy-silanes, siloxanes, glycols or polyglycols, mineral oil, synthetic oil, natural oil, and mixtures thereof.

The capillary openings may have an area in the range of from about 100 $\mu m^2$ to about 5 $mm^2$.

The electric field strength may be in the range of from about 50 kV/m to about 500 kV/m.

The voltage bias unit may simultaneously provide DC and AC voltages.

The delivery member may be located upstream of the cleaning unit and downstream of the bias charging unit.

The functional material may be a paraffin oil.

Disclosed in further embodiments is a method for lubricating an imaging member surface. The method includes monitoring the friction induced torque between the imaging member surface and a cleaning blade; and generating an electric field between the imaging member surface and a delivery member when the friction exceeds a predetermined level. The delivery member is spaced apart from the imaging member surface. The delivery member includes a reservoir containing a lubricant and a plurality of capillary openings. The lubricant is electrohydrodynamically delivered to the imaging member surface when the electric field is generated.

The plurality of capillary openings may be located from about 0.1 mm to about 30 mm from the imaging member surface.

The lubricant may be a paraffin oil.

The electric field strength may be in the range of from about 50 kV/m to about 500 kV/m.

These and other non-limiting characteristics of the disclosure are more particularly disclosed below.

BRIEF DESCRIPTION OF THE DRAWINGS

The following is a brief description of the drawings, which are presented for the purposes of illustrating the exemplary embodiments disclosed herein and not for the purposes of limiting the same.

DETAILED DESCRIPTION

Figure 1:
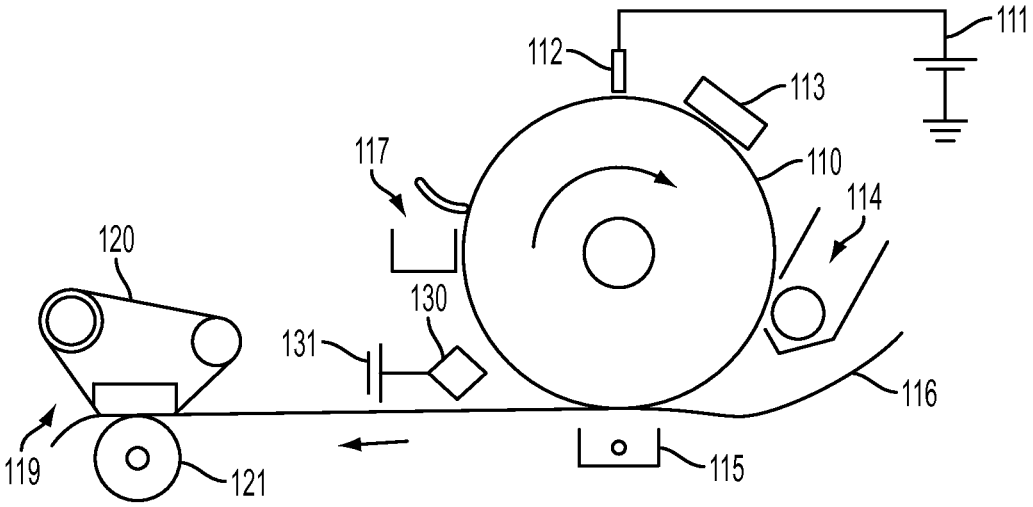
FIG. 1 illustrates an exemplary image forming apparatus of the present disclosure.

A more complete understanding of the components, processes and apparatuses disclosed herein can be obtained by reference to the accompanying drawings. These figures are merely schematic representations based on convenience and the ease of demonstrating the present disclosure, and are, therefore, not intended to indicate relative size and dimensions of the devices or components thereof and/or to define or limit the scope of the exemplary embodiments.

Although specific terms are used in the following description for the sake of clarity, these terms are intended to refer only to the particular structure of the embodiments selected for illustration in the drawings, and are not intended to define or limit the scope of the disclosure. In the drawings and the following description below, it is to be understood that like numeric designations refer to components of like function.

The singular forms "a," "an," and "the" include plural referents unless the context clearly dictates otherwise.

Numerical values in the specification and claims of this application should be understood to include numerical values which are the same when reduced to the same number of significant figures and numerical values which differ from the stated value by less than the experimental error of conventional measurement technique of the type described in the present application to determine the value.

All ranges disclosed herein are inclusive of the recited endpoint and independently combinable (for example, the range of "from 2 grams to 10 grams" is inclusive of the endpoints, 2 grams and 10 grams, and all the intermediate values). The endpoints of the ranges and any values disclosed herein are not limited to the precise range or value; they are sufficiently imprecise to include values approximating these ranges and/or values.

A value modified by a term or terms, such as "about" and "substantially," may not be limited to the precise value specified. The approximating language may correspond to the precision of an instrument for measuring the value. The modifier "about" should also be considered as disclosing the range defined by the absolute values of the two endpoints. For example, the expression "from about 2 to about 4" also discloses the range "from 2 to 4."

"Electrohydrodynamic" refers to ejecting a fluid under an electric charge applied to the orifice region of the nozzle. When the electrostatic force is sufficiently large to overcome the surface tension of the fluid at the nozzle, fluid is ejected from the nozzle.

"Ejection orifice" refers to the region of the nozzle from which the fluid is capable of being ejected under an electric charge. The "ejection area" of the ejection orifice refers to the effective area of the nozzle facing the substrate surface. In an embodiment, the ejection area corresponds to a circle, so that the diameter of the ejection orifice (D) is calculated from the ejection area (A) by: D=sqrt(4 A/pi). A "substantially circular" orifice refers to an orifice having a generally smooth-shaped circumference (e.g., no distinct, sharp corners), where the minimum length across the orifice is at least 80% of the corresponding maximum length across the orifice (such as an ellipse whose major and minor diameters are within 20% of each other). "Average diameter" is calculated as the average of the minimum and maximum dimension. Similarly, other shapes are characterized as substantially shaped, such as a square, rectangle, triangle, where the corners may be curved and the lines may be substantially straight. In an aspect, substantially straight refers to a line having a maximum deflection position that is less than 10% of the line length.

"Electric charge" refers to the potential difference between the printing fluid within the nozzle (e.g., the fluid in the vicinity of the ejection orifice) and the substrate surface. This electric charge may be generated by providing a bias or electric potential to one electrode compared to a counter electrode.

The present disclosure relates to image forming apparatuses that include a delivery member and a power supply for electrohydrodynamically applying a functional material to an imaging member surface using the delivery member. The delivery member is spaced apart from the imaging member surface (i.e., there is a physical gap between the imaging member and the delivery member) and thus several drawbacks of known apparatuses are minimized/eliminated.

Referring to FIG. 1, the structure of an imaging member using the delivery member is depicted. In the depicted embodiment, the imaging member surface 110 rotates clockwise. The charge-retentive surface of imaging member 110 is charged by a charging unit/member (e.g., a bias charging roller) 112 to which a voltage has been supplied from power supply 111. The charging unit 112 may be in contact, semi-contact, or non-contact with the imaging member surface 110. The charging unit is configured to apply an electrostatic charge on the charge-retentive surface to a predetermined electric potential (e.g., from about 500 V to about 1 kV). The imaging member is then imagewise exposed to light from an optical system or an image input apparatus 113, such as a light unit (e.g., a laser or a light emitting diode, to form an electrostatic latent image thereon. Generally, the electrostatic latent image is developed by bringing a developer mixture from developer station 114 into contact therewith. Development can be effected by use of a magnetic brush, powder cloud, or other known development process. A dry developer mixture usually comprises carrier granules having toner particles adhering triboelectrically thereto. Toner particles are attracted from the carrier granules to the latent image forming a toner powder image thereon. Alternatively, a liquid developer material may be employed, which includes a liquid carrier having toner particles dispersed therein. The liquid developer material is advanced into contact with the electrostatic latent image and the toner particles are deposited thereon. After the toner particles have been deposited on the photoconductive surface, they are transferred to a copy substrate 116 by transfer component 115, which can be pressure transfer or electrostatic transfer. Alternatively, the developed image can be transferred to an intermediate transfer member, or bias transfer member, and subsequently transferred to a copy substrate. Examples of copy substrates include paper, transparency material such as polyester, polycarbonate, or the like, cloth, wood, or any other desired material upon which the finished image will be situated. After the transfer of the developed image is completed, copy substrate 116 advances to fusing member 119, depicted as fuser belt 120 and pressure roll 121, wherein the developed image is fused to copy substrate 116 by passing the copy substrate between the fuser belt and pressure roll, thereby forming a permanent image. Alternatively, transfer and fusing can be effected by a transfix application. The imaging member 110 then advances to cleaning station 117, wherein any remaining toner is cleaned therefrom by use of a blade, brush, or other cleaning apparatus.

The apparatus further includes a delivery member 130 for applying a functional material to the surface of the imaging member 110. The delivery member 130 is spaced apart from the surface of the imaging member 110 (i.e., the delivery member 130 is not in physical contact with the imaging member surface 110). A power supply/voltage bias unit 131 is configured to generate an electric field between the delivery member 130 and the surface of the imaging member 110. Although the depicted power supply 131 is a distinct component from the power supply 111, it should be understood that a single power supply may be used to supply voltage to the bias charging roller 112 and to generate the electrical field between the delivery member 130 and the surface of the imaging member 110. The imaging member may be biased to a positive voltage and the delivery member may be biased to a negative voltage. Generating the electrical field causes the delivery member to electrohydrodynamically apply a functional material to the imaging member surface 110.

Application of an electric charge establishes an electric field that results in the functional material being deposited on the imaging member surface. The electric charge can be applied intermittently at a given frequency. The pulsed voltage or electric charge may be a square wave, sawtooth, sinusoidal, or combinations thereof.

The voltage(s) provided by the power supply or power supplies may be standard line voltage(s) or other voltage levels or signal frequencies which may be desirable in accordance with other limiting factors dependent upon individual machine design. The power supply or power supplies may provide a DC voltage, an AC voltage, or combinations thereof. In some embodiments, the power supply or power supplies are configured to provide AC and DC voltages simultaneously.

The power supply or power supplies may be a high voltage power supply or power supplies. In some embodiments, the electric field may be greater than or equal to 100 kV/m. The electric field may be calculated by dividing the applied voltage by the distance between the delivery member 130 and the imaging member surface 110. The distance may be from about 10 micrometers (μm) to about 200 μm. For example, at a distance of about 3 cm, an applied voltage of about 9 kV would generate an electric field of about 300 kV/m.

Figure 2:
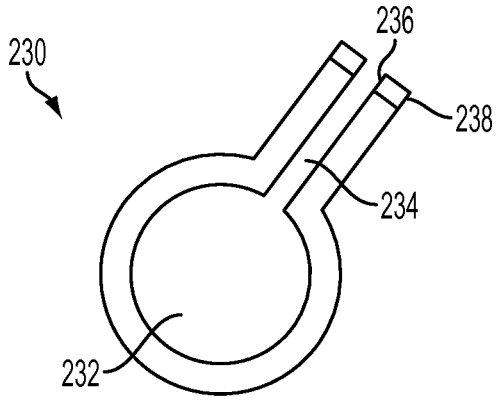
FIG. 2 illustrates an exemplary delivery member of the present disclosure.

FIG. 2 is a cross-sectional view showing the various parts of a delivery member 230 suitable for electrohydrodynamic (EHD) applications. The delivery member includes a reservoir 232 and one or more capillaries 234 extending therefrom to one or more capillary openings 236. The reservoir 232 is suitable for containing a liquid phase functional material. When an electric field is applied between the delivery member 230 and a surface of the imaging member, the functional material is pulled from the reservoir 232 via the one or more capillaries 234 and ejected onto the imaging member surface via the plurality of capillary openings 236. An electrode 238 is present at the capillary opening to provide electrical charge and form the electrical field between the delivery member and the imaging member. Alternatively, the capillary itself can be made from a conductive material, or coated with a conductive material, that serves as an electrode. The reservoir and the capillaries can be one integral component, or can be fluidly connected to each other.

The capillary openings may have an area in the range of from about 0.01 $\mu m^2$ to about 0.25 $mm^2$. In this regard, it is desirable that the functional material be released from the delivery member in the form of fine liquid droplets, rather than as a stream.

The devices and methods disclosed herein recognize that by maintaining a smaller nozzle size, the electric field can be better confined to control the placement of the functional material and access smaller droplet sizes. Accordingly, in some aspects of the disclosure, the ejection orifices from which the functional material is ejected may be substantially circular, and have a diameter that is less than 30 micrometers (μm), less than 20 μm, less than 10 μm, less than 5 μm, or less than less than 1 μm. Any of these ranges are optionally constrained by a lower limit that is functionally achievable, such as a minimum dimension that does not result in excessive clogging, for example, a lower limit that is greater than 100 nm, 300 nm, or 500 nm. Other orifice cross-section shapes may be used as disclosed herein, with characteristic dimensions equivalent to the diameter ranges described. Not only do these small nozzle diameters provide the capability of accessing ejected and printed smaller droplet diameters, but they also provide for electric field confinement that provides improved placement accuracy. The combination of a small orifice dimension and related highly-confined electric field provides high-resolution printing.

Because an important feature in this system is the small dimension of the ejection orifice, the orifice is optionally further described in terms of an ejection area corresponding to the cross-sectional area of the nozzle outlet. In an embodiment, the ejection area is selected from a range that is less than 700 $\mu m^2$, or between 0.07 $\mu m^2$ and 700 $\mu m^2$. Accordingly, if the ejection orifice is circular, this corresponds to a diameter range that is between about 0.4 μm and 30 μm. If the orifice is substantially square, each side of the square is between about 0.35 μm and 26.5 μm. In an aspect, the system provides the capability of printing features, such as single ion and/or quantum dot (e.g., having a size as small as about 5 nm).

In an embodiment, any of the systems are further described in terms of a printing resolution. In embodiments, the resolution is better than 50 μm or 20 μm, better than 10 μm, better than 5 μm, better than 1 μm, between about 5 nm and 10 μm, between 100 nm and 10 μm, between 300 nm and 5 μm, or between about 500 nm and about 10 μm. In embodiments, the orifice area and/or stand-off distance are selected to provide nanometer resolution, including resolution as fine as 5 nm for printing single ion or quantum dots having a printed size of about 5 nm, such as an orifice size that is smaller than 0.15 $\mu m^2$.

The nozzle is made of any material that is compatible with the systems and methods provided herein. For example, the nozzle is preferably a substantially nonconducting material so that the electric field is confined in the orifice region. In addition, the material should be capable of being formed into a nozzle geometry having a small dimension ejection orifice. In an embodiment, the nozzle is tapered toward the ejection orifice. One example of a compatible nozzle material is microcapillary glass. Another example is a nozzle-shaped passage within a solid substrate, whose surface is coated with a membrane, such as silicon nitride or silicon dioxide.

Irrespective of the nozzle material, a means for establishing an electric charge to the printing fluid within the nozzle, such as fluid at the nozzle orifice or a drop extending therefrom, is required. In an embodiment, a voltage source is in electrical contact with a conducting material that at least partially coats the nozzle. The conducting material may be a conducting metal, e.g., gold, that has been sputter-coated around the ejection orifice. Alternatively, the conductor may be a non-conducting material doped with a conductor, such as an electroconductive polymer (e.g., metal-doped polymer), or a conductive plastic. In another aspect, electric charge to the printing fluid is provided by an electrode having an end that is in electrical communication with the printing fluid in the nozzle.

Functional materials that can be applied using this delivery member include a lubricant material, a hydrophobic material, an oleophobic material, an amphiphilic material, and mixtures thereof. Illustrative examples of functional materials may include, for example, a liquid material selected from the group consisting of hydrocarbons, fluorocarbons, mineral oil, synthetic oil, natural oil, and mixtures thereof. The functional materials may further contain a functional group that facilitates adsorption of the functional materials on the photoreceptor surface, and optionally a reactive group that can chemically modify the photoreceptor surface. For examples, the functional materials may comprise paraffinic compounds, alkanes, fluoroalkanes, alkyl silanes, fluoroalkyl silanes alkoxy-silanes, siloxanes, glycols or polyglycols, mineral oil, synthetic oil, natural oil or mixture thereof.

The imaging member itself may comprise a substrate 32, optional hole blocking layer 34, optional adhesive layer 36, charge generating layer 38, charge transport layer 40, and an optional overcoat layer 42. Two exemplary embodiments of an imaging member are seen in FIG. 3 and FIG. 4.

Figure 3:
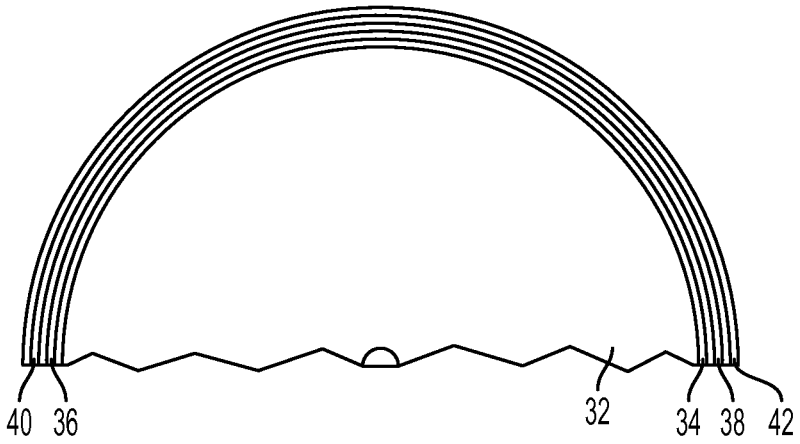
FIG. 3 is a cross-sectional view of an exemplary embodiment of a photoreceptor drum having a single charge transport layer.

The first exemplary embodiment of an imaging member that may be used in conjunction with the present disclosure is the photoreceptor drum of FIG. 3. The substrate 32 supports the other layers, and is the central portion of the drum. An optional hole blocking layer 34 can also be applied to the substrate, as well as an optional adhesive layer 36. Next, the charge generating layer 38 is applied so as to be located between the substrate 32 and the charge transport layer 40. If desired, an overcoat layer 42 may be placed upon the charge transport layer 40. Thus, either the charge transport layer or the overcoat layer will be the outermost exposed layer of the imaging member, and will provide the surface upon which the developer and functional material are applied.

Figure 4:
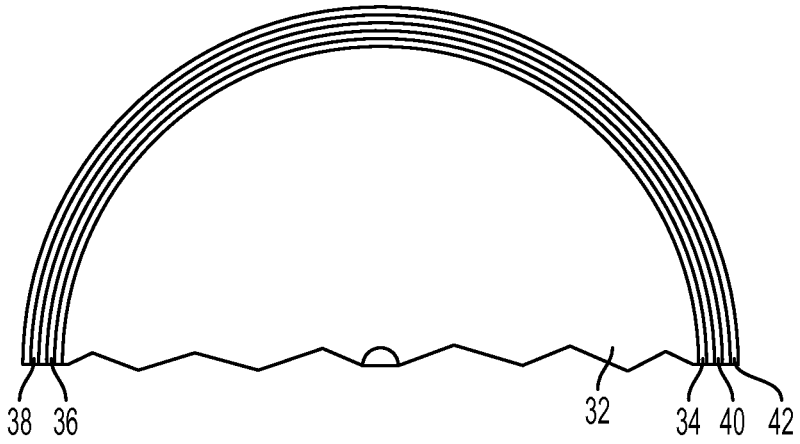
FIG. 4 is a cross-sectional view of another exemplary embodiment of a photoreceptor drum having a single charge transport layer.

Another exemplary embodiment of the photoreceptor drum of the present disclosure is illustrated in FIG. 4. This embodiment is similar to that of FIG. 3, except the locations of the charge generating layer 38 and charge transport layer 40 are reversed. Generally, the charge generating layer, charge transport layer, and other layers may be applied in any suitable order to produce either positive or negative charging photoreceptor drums.

Substrate

The substrate support 32 provides support for all layers of the imaging member. It has the shape of a rigid drum and has a diameter necessary for the imaging application it will be used for. The entire substrate can comprise the same material as that in the electrically conductive surface, or the electrically conductive surface can be merely a coating on the substrate. Any suitable electrically conductive material can be employed, such as for example, metal or metal alloy. Electrically conductive materials include copper, brass, nickel, zinc, chromium, stainless steel, conductive plastics and rubbers, aluminum, semitransparent aluminum, steel, cadmium, silver, gold, zirconium, niobium, tantalum, vanadium, hafnium, titanium, nickel, niobium, stainless steel, chromium, tungsten, molybdenum, paper rendered conductive by the inclusion of a suitable material therein or through conditioning in a humid atmosphere to ensure the presence of sufficient water content to render the material conductive, indium, tin, metal oxides, including tin oxide and indium tin oxide, and the like. It could be a single metallic compound or dual layers of different metals and/or oxides.

The substrate can also be formulated entirely of an electrically conductive material, or it can be an insulating material including inorganic or organic polymeric materials, such as MYLAR, a commercially available biaxially oriented polyethylene terephthalate from DuPont, or polyethylene naphthalate available as KALEDEX 2000, with a ground plane layer comprising a conductive titanium or titanium/zirconium coating, otherwise a layer of an organic or inorganic material having a semiconductive surface layer, such as indium tin oxide, aluminum, titanium, and the like, or exclusively be made up of a conductive material such as, aluminum, chromium, nickel, brass, other metals and the like. The thickness of the support substrate depends on numerous factors, including mechanical performance and economic considerations.

The Hole Blocking Layer

An optional hole blocking layer 34 may be applied to the substrate 32 or coatings. Any suitable and conventional blocking layer capable of forming an electronic barrier to holes between the adjacent photoconductive layer 38 and the underlying conductive surface of substrate 32 may be used. Electron blocking layers for positively charged photoreceptors allow holes from the imaging surface of the photoreceptor to migrate toward the conductive layer. For negatively charged photoreceptors, any suitable hole blocking layer capable of forming a barrier to prevent hole injection from the conductive layer to the opposite photoconductive layer may be utilized. The hole blocking layer may include polymers such as polyvinylbutryral, epoxy resins, polyesters, polysiloxanes, polyamides, polyurethanes and the like, or may be nitrogen containing siloxanes or nitrogen containing titanium compounds such as trimethoxysilyl propylene diamine, hydrolyzed trimethoxysilyl propyl ethylene diamine, N-beta-(aminoethyl) gamma-amino-propyl trimethoxy silane, isopropyl 4-aminobenzene sulfonyl, di(dodecylbenzene sulfonyl) titanate, isopropyl di(4-aminobenzoyl)isostearoyl titanate, isopropyl tri(N-ethylamino-ethylamino)titanate, isopropyl trianthranil titanate, isopropyl tri(N,N-dimethyl-ethylamino)titanate, titanium-4-amino benzene sulfonate oxyacetate, titanium 4-aminobenzoate isostearate oxyacetate, $[H_2N(CH_2)_4]CH_3Si(OCH_3)_2$, (gamma-aminobutyl) methyl diethoxysilane, and $[H_2N(CH_2)_3]CH_3Si(OCH_3)_2$ (gamma-aminopropyl) methyl diethoxysilane.

General embodiments of the undercoat layer may comprise a metal oxide and a resin binder. The metal oxides that can be used with the embodiments herein include, but are not limited to, titanium oxide, zinc oxide, tin oxide, aluminum oxide, silicon oxide, zirconium oxide, indium oxide, molybdenum oxide, and mixtures thereof. Undercoat layer binder materials may include, for example, polyesters, MOR-ESTER 49,000 from Morton International Inc., VITEL PE-100, VITEL PE-200, VITEL PE-200D, and VITEL PE-222 from Goodyear Tire and Rubber Co., polyarylates such as ARDEL from AMOCO Production Products, polysulfone from AMOCO Production Products, polyurethanes, and the like.

The hole blocking layer should be continuous and have a thickness of less than about 0.5 micrometer because greater thicknesses may lead to undesirably high residual voltage. A hole blocking layer of between about 0.005 micrometer and about 0.3 micrometer is used because charge neutralization after the exposure step is facilitated and optimum electrical performance is achieved. A thickness of between about 0.03 micrometer and about 0.06 micrometer is used for hole blocking layers for optimum electrical behavior. The hole blocking layers that contain metal oxides such as zinc oxide, titanium oxide, or tin oxide, may be thicker, for example, having a thickness up to about 25 micrometers. The blocking layer may be applied by any suitable conventional technique such as spraying, dip coating, draw bar coating, gravure coating, silk screening, air knife coating, reverse roll coating, vacuum deposition, chemical treatment and the like. For convenience in obtaining thin layers, the blocking layer is applied in the form of a dilute solution, with the solvent being removed after deposition of the coating by conventional techniques such as by vacuum, heating and the like. Generally, a weight ratio of between about 0.05:100 to about 0.5:100 for the hole blocking layer material and solvent is satisfactory for spray coating.

The Adhesive Layer

An optional adhesive layer 36 may be applied to the hole-blocking layer 34. Any suitable adhesive layer well known in the art may be used. Typical adhesive layer materials include, for example, polyesters, polyurethanes, and the like. Satisfactory results may be achieved with adhesive layer thickness between about 0.05 micrometer (500 angstroms) and about 0.3 micrometer (3,000 angstroms). Conventional techniques for applying an adhesive layer coating mixture to the hole blocking layer include spraying, dip coating, roll coating, wire wound rod coating, gravure coating, Bird applicator coating, and the like. Drying of the deposited coating may be effected by any suitable conventional technique such as oven drying, infrared radiation drying, air drying and the like.

The Charge Generation Layer

The charge generation layer may thereafter be applied to the undercoat layer. Any suitable charge generation binder including a charge generating/photoconductive material, which may be in the form of particles and dispersed in a film forming binder, such as an inactive resin, may be utilized. Examples of charge generating materials include, for example, inorganic photoconductive materials such as amorphous selenium, trigonal selenium, and selenium alloys selected from the group consisting of selenium-tellurium, selenium-tellurium-arsenic, selenium arsenide and mixtures thereof, and organic photoconductive materials including various phthalocyanine pigments such as the X-form of metal free phthalocyanine, metal phthalocyanines such as vanadyl phthalocyanine and copper phthalocyanine, hydroxy gallium phthalocyanines, chlorogallium phthalocyanines, titanyl phthalocyanines, quinacridones, dibromo anthanthrone pigments, benzimidazole perylene, substituted 2,4-diamino-triazines, polynuclear aromatic quinones, enzimidazole perylene, and the like, and mixtures thereof, dispersed in a film forming polymeric binder. Selenium, selenium alloy, benzimidazole perylene, and the like and mixtures thereof may be formed as a continuous, homogeneous charge generation layer. Benzimidazole perylene compositions are well known and described, for example, in U.S. Pat. No. 4,587,189, the entire disclosure thereof being incorporated herein by reference. Multi-charge generation layer compositions may be used where a photoconductive layer enhances or reduces the properties of the charge generation layer. Other suitable charge generating materials known in the art may also be utilized, if desired. The charge generating materials selected should be sensitive to activating radiation having a wavelength between about 400 nm and about 900 nm during the imagewise radiation exposure step in an electrophotographic imaging process to form an electrostatic latent image. For example, hydroxygallium phthalocyanine absorbs light of a wavelength of from about 370 nm to about 950 nm, as disclosed, for example, in U.S. Pat. No. 5,756,245, the entire disclosure thereof being incorporated herein by reference.

Any suitable inactive resin materials may be employed as a binder in the charge generation layer, including those described, for example, in U.S. Pat. No. 3,121,006, the entire disclosure thereof being incorporated herein by reference. Organic resinous binders include thermoplastic and thermosetting resins such as one or more of polycarbonates, polyesters, polyamides, polyurethanes, polystyrenes, polyarylethers, polyarylsulfones, polybutadienes, polysulfones, polyethersulfones, polyethylenes, polypropylenes, polyimides, polymethylpentenes, polyphenylene sulfides, polyvinyl butyral, polyvinyl acetate, polysiloxanes, polyacrylates, polyvinyl acetals, polyamides, polyimides, amino resins, phenylene oxide resins, terephthalic acid resins, epoxy resins, phenolic resins, polystyrene and acrylonitrile copolymers, polyvinylchloride, vinylchloride and vinyl acetate copolymers, acrylate copolymers, alkyd resins, cellulosic film formers, poly(amideimide), styrene-butadiene copolymers, vinylidenechloride/vinylchloride copolymers, vinylacetate/vinylidene chloride copolymers, styrene-alkyd resins, and the like. Another film-forming polymer binder is PCZ-400 (poly (4,4'-dihydroxy-diphenyl-1-1-cyclohexane) which has a viscosity-molecular weight of 40,000 and is available from Mitsubishi Gas Chemical Corporation (Tokyo, Japan).

The charge generating material can be present in the resinous binder composition in various amounts. Generally, at least about 5 percent by volume, or no more than about 90 percent by volume of the charge generating material is dispersed in at least about 95 percent by volume, or no more than about 10 percent by volume of the resinous binder, and more specifically at least about 20 percent, or no more than about 60 percent by volume of the charge generating material is dispersed in at least about 80 percent by volume, or no more than about 40 percent by volume of the resinous binder composition.

In specific embodiments, the charge generation layer may have a thickness of at least about 0.1 μm, or no more than about 2 μm, or of at least about 0.2 μm, or no more than about 1 μm. These embodiments may be comprised of chlorogallium phthalocyanine or hydroxygallium phthalocyanine or mixtures thereof. The charge generation layer containing the charge generating material and the resinous binder material generally ranges in thickness of at least about 0.1 μm, or no more than about 5 μm, for example, from about 0.2 μm to about 3 μm when dry. The charge generation layer thickness is generally related to binder content. Higher binder content compositions generally employ thicker layers for charge generation.

Charge Transport Layer

In a drum photoreceptor, the charge transport layer comprises a single layer of the same composition. As such, the charge transport layer will be discussed specifically in terms of a single layer, but the details will be also applicable to an embodiment having dual charge transport layers. The charge transport layer is applied over the charge generation layer and may include any suitable transparent organic polymer or non-polymeric material capable of supporting the injection of photogenerated holes or electrons from the charge generation layer and capable of allowing the transport of these holes/electrons through the charge transport layer to selectively discharge the surface charge on the imaging member surface. In one embodiment, the charge transport layer not only serves to transport holes, but also protects the charge generation layer from abrasion or chemical attack and may therefore extend the service life of the imaging member. The charge transport layer can be a substantially non-photoconductive material, but one which supports the injection of photogenerated holes from the charge generation layer.

The charge transport layer is normally transparent in a wavelength region in which the electrophotographic imaging member is to be used when exposure is affected there to ensure that most of the incident radiation is utilized by the underlying charge generation layer. The charge transport layer should exhibit excellent optical transparency with negligible light absorption and no charge generation when exposed to a wavelength of light useful in xerography, e.g., 400 nm to 900 nm. In the case when the photoreceptor is prepared with the use of a transparent substrate and also a transparent or partially transparent conductive layer, imagewise exposure or erasure may be accomplished through the substrate with all light passing through the back side of the substrate. In this case, the materials of the charge transport layer need not transmit light in the wavelength region of use if the charge generation layer is sandwiched between the substrate and the charge transport layer. The charge transport layer in conjunction with the charge generation layer is an insulator to the extent that an electrostatic charge placed on the charge transport layer is not conducted in the absence of illumination. The charge transport layer should trap minimal charges as the charge passes through it during the discharging process.

The charge transport layer may include any suitable charge transport component or activating compound useful as an additive dissolved or molecularly dispersed in an electrically inactive polymeric material, such as a polycarbonate binder, to form a solid solution and thereby making this material electrically active. "Dissolved" refers, for example, to forming a solution in which the small molecule is dissolved in the polymer to form a homogeneous phase; and molecularly dispersed in embodiments refers, for example, to charge transporting molecules dispersed in the polymer, the small molecules being dispersed in the polymer on a molecular scale. The charge transport component may be added to a film forming polymeric material which is otherwise incapable of supporting the injection of photogenerated holes from the charge generation material and incapable of allowing the transport of these holes. This addition converts the electrically inactive polymeric material to a material capable of supporting the injection of photogenerated holes from the charge generation layer and capable of allowing the transport of these holes through the charge transport layer in order to discharge the surface charge on the charge transport layer.

The high mobility charge transport component may comprise small molecules of an organic compound which cooperate to transport charge between molecules and ultimately to the surface of the charge transport layer. For example, but not limited to, N,N'-diphenyl-N,N-bis(3-methyl phenyl)-1,1'-biphenyl-4,4'-diamine (TPD), other arylamines like triphenyl amine, N,N,N',N'-tetra-p-tolyl-1,1'-biphenyl-4,4'-diamine (TM-TPD), and the like.

A number of charge transport compounds can be included in the charge transport layer, which layer generally is of a thickness of from about 5 micrometers to about 75 micrometers, and more specifically, of a thickness of from about 15 micrometers to about 40 micrometers. Examples of charge transport components are aryl amines.

Examples of the binder materials selected for the charge transport layers include components, such as those described in U.S. Pat. No. 3,121,006, the disclosure of which is totally incorporated herein by reference in its entirety. Specific examples of polymer binder materials include polycarbonates, polyarylates, acrylate polymers, vinyl polymers, cellulose polymers, polyesters, polysiloxanes, polyamides, polyurethanes, poly(cyclo olefins), and epoxies, and random or alternating copolymers thereof. In embodiments, the charge transport layer, such as a hole transport layer, may have a thickness of at least about 10 μm, or no more than about 40 μm.

The charge transport layer should be an insulator to the extent that the electrostatic charge placed on the hole transport layer is not conducted in the absence of illumination at a rate sufficient to prevent formation and retention of an electrostatic latent image thereon. The charge transport layer is substantially nonabsorbing to visible light or radiation in the region of intended use, but is electrically "active" in that it allows the injection of photogenerated holes from the photoconductive layer, that is the charge generation layer, and allows these holes to be transported through itself to selectively discharge a surface charge on the surface of the active layer.

In addition, in the present embodiments using a belt configuration, the charge transport layer may consist of a single pass charge transport layer or a dual pass charge transport layer (or dual layer charge transport layer) with the same or different transport molecule ratios. In these embodiments, the dual layer charge transport layer has a total thickness of from about 10 μm to about 40 μm. In other embodiments, each layer of the dual layer charge transport layer may have an individual thickness of from 2 μm to about 20 μm. Moreover, the charge transport layer may be configured such that it is used as a top layer of the photoreceptor to inhibit crystallization at the interface of the charge transport layer and the overcoat layer. In another embodiment, the charge transport layer may be configured such that it is used as a first pass charge transport layer to inhibit microcrystallization occurring at the interface between the first pass and second pass layers.

The Overcoat Layer

Other layers of the imaging member may include, for example, an optional over coat layer. The optional overcoat layer, if desired, may be disposed over the charge transport layer to provide imaging member surface protection as well as improve resistance to abrasion. In embodiments, the overcoat layer may have a thickness ranging from about 0.1 micrometer to about 15 micrometers or from about 1 micrometer to about 10 micrometers, or in a specific embodiment, about 3 micrometers to about 10 micrometers. These overcoating layers typically comprise a charge transport component and an optional organic polymer or inorganic polymer. These overcoating layers may include thermoplastic organic polymers or cross-linked polymers such as thermosetting resins, UV or e-beam cured resins, and the like. The overcoat layers may further include a particulate additive such as metal oxides including aluminum oxide and silica, or low surface energy polytetrafluoroethylene (PTFE), and combinations thereof.

Any known or new overcoat materials may be included for the present embodiments. In embodiments, the overcoat layer may include a charge transport component or a cross-linked charge transport component. In particular embodiments, for example, the overcoat layer comprises a charge transport component comprised of a tertiary arylamine containing a substituent capable of self cross-linking or reacting with the polymer resin to form a cured composition. Specific examples of charge transport components suitable for overcoat layer comprise the tertiary arylamine with a general formula of

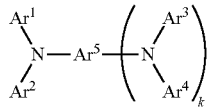

wherein $Ar^1$, $Ar^2$, $Ar^3$, and $Ar^4$ each independently represents an aryl group having about 6 carbon atoms to about 30 carbon atoms, $Ar^5$ represents aromatic hydrocarbon group having about 6 carbon atoms to about 30 carbon atoms, and k represents 0 or 1, and wherein at least one of $Ar^1$, $Ar^2$, $Ar^3$ $Ar^4$, and $Ar^5$ comprises a substituent selected from the group consisting of hydroxyl (—OH), a hydroxymethyl (—$CH_2OH$), an alkoxymethyl (—$CH_2OR$, wherein R is an alkyl having 1 carbon atoms to about 10 carbons), a hydroxylalkyl having 1 carbon atoms to about 10 carbons, and mixtures thereof. In other embodiments, $Ar^1$, $Ar^2$, $Ar^3$, and $Ar^4$ each independently represent a phenyl or a substituted phenyl group, and $Ar^5$ represents a biphenyl or a terphenyl group.

The Ground Strip

The ground strip may comprise a film forming polymer binder and electrically conductive particles. Any suitable electrically conductive particles may be used in the electrically conductive ground strip layer. The ground strip may comprise materials which include those enumerated in U.S. Pat. No. 4,664,995 incorporated in its entirety by reference herein. Electrically conductive particles include carbon black, graphite, copper, silver, gold, nickel, tantalum, chromium, zirconium, vanadium, niobium, indium tin oxide and the like. The electrically conductive particles may have any suitable shape. Shapes may include irregular, granular, spherical, elliptical, cubic, flake, filament, and the like. The electrically conductive particles should have a particle size less than the thickness of the electrically conductive ground strip layer to avoid an electrically conductive ground strip layer having an excessively irregular outer surface. An average particle size of less than about 10 micrometers generally avoids excessive protrusion of the electrically conductive particles at the outer surface of the dried ground strip layer and ensures relatively uniform dispersion of the particles throughout the matrix of the dried ground strip layer. The concentration of the conductive particles to be used in the ground strip depends on factors such as the conductivity of the specific conductive particles utilized.

The ground strip layer may have a thickness of at least about 7 micrometers, or no more than about 42 micrometers, or of at least about 14 micrometers, or no more than about 27 micrometers.

The Anti-Curl Back Coating Layer

The anti-curl back coating may comprise organic polymers or inorganic polymers that are electrically insulating or slightly semi-conductive. The anti-curl back coating provides flatness and/or abrasion resistance.

Anti-curl back coating may be formed at the back side of the substrate 10, opposite to the imaging layers. The anti-curl back coating may comprise a film forming resin binder and an adhesion promoter additive. The resin binder may be the same resins as the resin binders of the charge transport layer discussed above. Examples of film forming resins include polyacrylate, polystyrene, bisphenol polycarbonate, poly(4,4'-isopropylidene diphenyl carbonate), 4,4'-cyclohexylidene diphenyl polycarbonate, and the like. Adhesion promoters used as additives include 49,000 (du Pont), Vitel PE-100, Vitel PE-200, Vitel PE-307 (Goodyear), and the like. Usually from about 1 to about 15 weight percent adhesion promoter is selected for film forming resin addition. The thickness of the anti-curl back coating is at least about 3 micrometers, or no more than about 35 micrometers, or about 14 micrometers.

The present disclosure will further be illustrated in the following non-limiting working example, it being understood that the example is intended to be illustrative only and the disclosure is not intended to be limited to the materials, conditions, process parameters, and the like recited herein.

EXAMPLE

An experimental setup was implemented on a printing apparatus. The setup included a photoreceptor, a developer, a bias charging roller, a cleaning blade, an electrohydrodynamic applicator as a delivery member upstream of the cleaning blade, and a high voltage power supply, similar to that seen in FIG. 1. For experimental purposes, the electrohydrodynamic applicator was formed from a plastic syringe (as a paraffin oil reservoir) and a small size conductive needle-type injector for effectively jetting paraffin oil from the reservoir to the photoreceptor surface. The distance between the injector and the photoreceptor surface was about 2 to about 3 centimeters.

A wire connected the high voltage power supply to the injector. The high voltage power supply included a scorotron power board to supply a scorotron wire voltage output of up to about 9 kV (on DC250). The electric field between the injected and the photoreceptor surface was about 300 kV/m.

The on/off switch of the high voltage power supply was controlled using a Labview program which monitored the torque of the photoreceptor drum motor.

Figure 5:
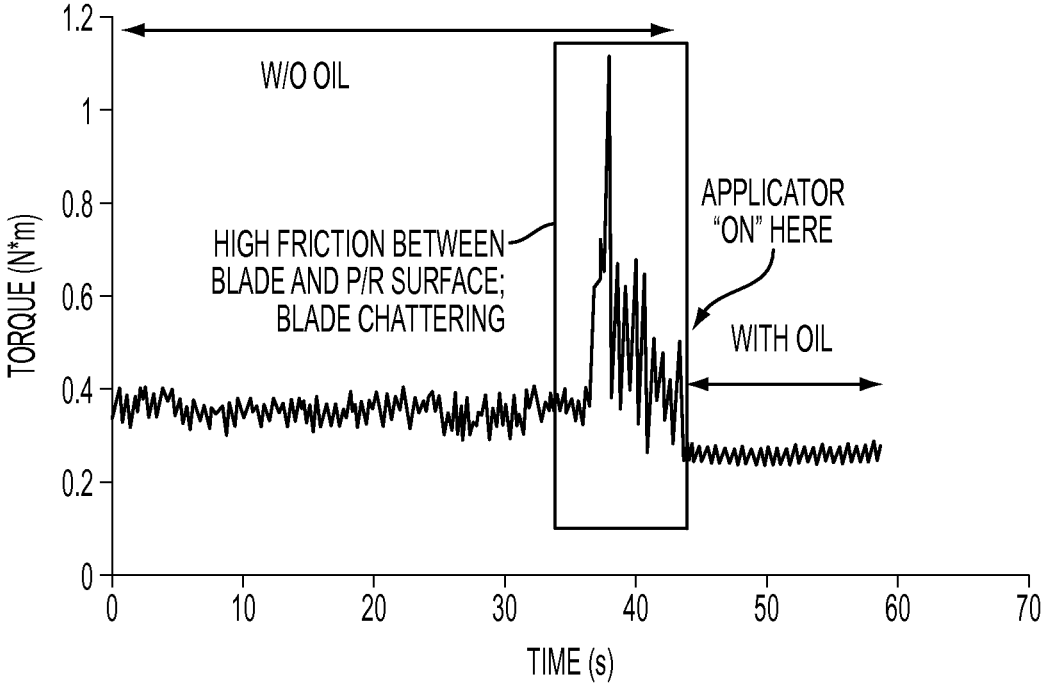
FIG. 5 is a graph showing how applying paraffin oil to a photoreceptor in accordance with an embodiment of the present disclosure affects torque.

The overcoated photoreceptor was used with a bias charging roller set at a DC voltage of about 700 V and an AC peak-to-peak of about 2.5 kV. Experimental results are illustrated in FIG. 5.

Under bias charging roller charging, the torque due to interaction between the cleaning blade and the overcoated photoreceptor surface slowly increased initially but then rapidly increased causing the cleaning blade to chatter. The system recognized the high torque level and the high voltage power supply was turned on to provide voltage to the applicator. After the paraffin oil was applied, the torque quickly returned to a normal level. Since the applicator was located upstream of the cleaning blade, the applied oil layer on the photoreceptor was leveled to be more even.

It will be appreciated that variants of the above-disclosed and other features and functions, or alternatives thereof, may be combined into many other different systems or applications. Various presently unforeseen or unanticipated alternatives, modifications, variations or improvements therein may be subsequently made by those skilled in the art which are also intended to be encompassed by the following claims.

The invention claimed is:

1. A method for providing a liquid functional material to an imaging member surface, comprising:

generating an electric field between the imaging member surface and a delivery member;

wherein the delivery member is spaced apart from the imaging member surface; and wherein the delivery member comprises a reservoir containing the liquid functional material and a plurality of capillary openings, the functional material being electrohydrodynamically delivered to the imaging member surface when the electric field is generated.

2. The method of claim 1, wherein the electric field strength is from about 50 kV/m to about 500 kV/m.

3. The method of claim 1, wherein the plurality of capillary openings are located from about 0.1 mm to about 30 mm from the imaging member surface.

4. The method of claim 1, wherein the functional material is selected from the group consisting of alkanes, fluoroalkanes, alkyl silanes, fluoroalkyl silanes alkoxy-silanes, siloxanes, glycols or polyglycols, mineral oil, synthetic oil, natural oil, and mixtures thereof.

5. The method of claim 1, wherein the functional material compromises a paraffin oil.

6. The method of claim 1, wherein the capillary openings have an area in the range of from about 100 $\mu m^2$ to about 5 $mm^2$.

7. An image forming apparatus comprising:

an electrophotographic imaging member having a charge-retentive surface to receive an electrostatic latent image thereon;

a bias charging unit for applying an electrostatic charge on the charge-retentive surface to a predetermined electric potential;

an exposing unit that exposes the charge-retentive surface to form an electrostatic latent image;

a developing unit that develops the electrostatic latent image using a developer containing toner to form a toner image;

a transferring unit that transfers the toner image to a recording medium;

a cleaning unit that removes toner remaining on the surface of the image bearing member; and a delivery member for providing a liquid functional material to the surface of the imaging member;

wherein a voltage bias unit is used for adjusting an electric field between the delivery member and the imaging member surface to electrohydrodynamically jet the functional material from the delivery member to the imaging member surface.

8. The image forming apparatus of claim 7, wherein the imaging member surface is spaced apart from the delivery member at a distance from about 0.1 mm to about 30 mm.

9. The image forming apparatus of claim 7, wherein the delivery member comprises a reservoir.

10. The image forming apparatus of claim 7, wherein the delivery member comprises a plurality of capillary openings directed towards the imaging member surface.

11. The image forming apparatus of claim 7, wherein the functional material is selected from the group consisting of alkanes, fluoroalkanes, alkyl silanes, fluoroalkyl silanes alkoxy-silanes, siloxanes, glycols or polyglycols, mineral oil, synthetic oil, natural oil, and mixtures thereof.

12. The image forming apparatus of claim 10, wherein the capillary openings have an area in the range of from about 100 $\mu m^2$ to about 5 $mm^2$.

13. The image forming apparatus of claim 7, wherein the electric field strength is ranging from about 50 kV/m to about 500 kV/m.

14. The image forming apparatus of claim 7, wherein the voltage bias unit simultaneously provides DC and AC voltages.

15. The image forming apparatus of claim 7, wherein the delivery member is located upstream of the cleaning unit and downstream of the bias charging unit.

16. The method of claim 7, wherein the functional material compromises a paraffin oil.

17. A method for lubricating an imaging member surface, comprising:

monitoring the friction-induced torque between the imaging member surface and a cleaning blade; and generating an electric field between the imaging member surface and a delivery member when the friction exceeds a predetermined level;

wherein the delivery member is spaced apart from the imaging member surface; and wherein the delivery member comprises a reservoir containing a lubricant and a plurality of capillary openings, the lubricant being electrohydrodynamically delivered to the imaging member surface when the electric field is generated.

18. The method of claim 17, wherein the plurality of capillary openings are located from about 0.1 mm to about 30 mm from the imaging member surface.

19. The method of claim 17, wherein the lubricant is a paraffin oil.

20. The method of claim 17, wherein the electric field strength is from about 50 kV/m to about 500 kV/m.

* * * * *